US009163633B2

(12) United States Patent
Park

(10) Patent No.: US 9,163,633 B2
(45) Date of Patent: Oct. 20, 2015

(54) VANE PUMP

(71) Applicant: LG ELECTRONICS INC., Seoul (KR)

(72) Inventor: Jaebong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/200,230

(22) Filed: Mar. 7, 2014

(65) Prior Publication Data

US 2014/0255237 A1 Sep. 11, 2014

(30) Foreign Application Priority Data

Mar. 8, 2013 (KR) ..... 10-2013-0025241

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 18/10*** | (2006.01) |
| ***F04C 29/12*** | (2006.01) |
| ***C22C 37/04*** | (2006.01) |

(Continued)

(52) U.S. Cl.

CPC ..... *F04C 18/10* (2013.01); *C22C 37/04* (2013.01); *F01C 21/0809* (2013.01); *F04C 2/3446* (2013.01); *F04C 29/12* (2013.01); *F04C 2230/21* (2013.01); *F04C 2240/20* (2013.01); *F05C 2201/0439* (2013.01); *F05C 2201/0448* (2013.01); *F05C 2203/0808* (2013.01)

(58) Field of Classification Search

CPC ..... F04C 2/344; F04C 2/3446; F04C 2/3442; F04C 29/12; F04C 2230/22; F04C 2230/41; F04C 2230/21; F04C 2230/91; F04C 2240/20; F01C 21/0809; F01C 21/0836; F01C 21/08; F01C 1/44; F01C 21/106; F05C 2201/0439; F05C 2201/0442; F05C 2201/0448; C22C 37/00; C22C 37/04

USPC ..... 418/259–260, 178–179

See application file for complete search history.

(56) References Cited

U.S. PATENT DOCUMENTS

| | | | | |
|---|---|---|---|---|
| 4,034,970 | A | 7/1977 | Akeel et al. | |
| 4,619,713 | A | 10/1986 | Suenaga et al. | 148/3 |
| 4,944,663 | A | 7/1990 | Iizuka et al. | 418/178 |

(Continued)

FOREIGN PATENT DOCUMENTS

| | | |
|---|---|---|
| CN | 101602434 | 12/2009 |
| DE | 10 2007 007293 A1 | 8/2008 |

(Continued)

OTHER PUBLICATIONS

European Search Report dated Jun. 18, 2014 issued in Application No. 14 158 578.6.

(Continued)

*Primary Examiner* — Theresa Trieu

(74) *Attorney, Agent, or Firm* — KED & Associates, LLP

(57) ABSTRACT

A vane pump is provided that may include a rotor having a plurality of slots formed on an outer circumferential surface thereof; a vane slidably inserted into each of the plurality of slots; and a cam ring configured to receive the rotor therein and having a inner circumferential surface in contact with an end portion of the vane. The rotor may be formed of nodular graphite cast iron, the vane may be formed of high speed tool steel, and the cam ring may be formed of alloy cast iron.

15 Claims, 5 Drawing Sheets

(51) Int. Cl.
*F01C 21/08* (2006.01)
*F04C 2/344* (2006.01)

(56) References Cited

U.S. PATENT DOCUMENTS

| | | | | |
|---|---|---|---|---|
| 5,028,281 | A * | 7/1991 | Hayes et al. | 148/321 |
| 5,419,973 | A | 5/1995 | Hashimoto et al. | |
| 6,372,180 | B1 | 4/2002 | Kemeny | |
| 2002/0122735 | A1* | 9/2002 | Bishop et al. | 418/259 |
| 2004/0042925 | A1 | 3/2004 | Skaland | |
| 2004/0187972 | A1* | 9/2004 | Ozaki | 148/334 |
| 2009/0162230 | A1* | 6/2009 | Fujita et al. | 418/259 |
| 2011/0017364 | A1 | 1/2011 | Park et al. | |
| 2013/0118651 | A1 | 5/2013 | Park | |
| 2013/0122325 | A1 | 5/2013 | Park | |

FOREIGN PATENT DOCUMENTS

| | | | | |
|---|---|---|---|---|
| EP | 0 450 847 | A1 | 10/1991 | |
| GB | 1500766 | A * | 2/1978 | C22C 38/56 |
| JP | S55-51988 | A | 4/1980 | |
| JP | 62048983 | A * | 3/1987 | 418/179 |
| JP | 4-129621 | | 4/1992 | |
| JP | 2000-119794 | | 4/2000 | |
| KR | 10-2013-0052977 | | 5/2013 | |

OTHER PUBLICATIONS

European Search Report dated Jul. 21, 2014 issued in Application No. 14158585.1-1353

U.S. Office Action dated June 29, 2015 issued in co-pending U.S. Appl. No. 14/200,211.

* cited by examiner

VANE PUMP

CROSS-REFERENCE TO RELATED APPLICATION(S)

Pursuant to 35 U.S.C. §119(a), this application claims priority to Korean Application No. 10-2013-0025241, filed in Korea on Mar. 8, 2013, the contents of which is incorporated by reference herein in its entirety.

BACKGROUND

1. Field

A vane pump is disclosed herein.

2. Background

Various devices have been utilized to provide double steering force in a steering device of vehicles. In the case of a hydraulic steering device, a power steering pump to supply oil pressure may be used. Various types of pumps may be utilized as a power steering pump, and in general, a vane pump having high efficiency, small volume, and weight, and generating less vibrations is utilized.

FIG. 1 is a schematic cross-sectional view of a related art vane pump. The vane pump may include a body 1 and a pump cartridge 3 installed in the body 1. The pump cartridge 3 may include a rotor 31 rotatably installed within the body 1, and a cam ring 30, in which the rotor 31 may be installed. In addition, a plurality of slots may be formed in the rotor 31, and a vane 32 may be slidably installed within each of the plurality of slots. The vane 32 may be pressurized toward an inner wall of the cam ring 30, thus preventing leakage between an end portion of the vane 32 and an inner wall surface of the cam ring 30.

The rotor 31 may be coupled to a rotational shaft 50 rotated by a driving force from an engine, so that the rotor 31 may be rotated together with a driving of the engine. When the rotor 31 is rotated, the vane 32 may also be rotated together to force-feed a fluid within a space defined by outer surfaces of the vane 32, cam ring 30, and rotor 31.

In the vane pump having the foregoing structure, continuous friction may be caused between an end of the vane 32 and the cam ring 30, and thus, the vane 32 and the cam ring 30 may be abraded. Friction may also be caused between inner walls of the slots of the rotor 31 and the vane 32. Thus, in order to reliably operate the vane pump for a long period of time, damage due to abrasion needs to be minimized.

In the related art vane pump used as a steering device of a vehicle, the cam ring 30 is formed of low-alloy steel, and the vane 32 is formed of high-alloy steel. Also, the rotor 31 is formed of carbonized and quenched gear steel. However, the cam ring and the rotor have low processibility and require a heat treatment for a long period of time, increasing manufacturing costs, and high coefficients of friction thereof result in significant damage due to abrasion.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail to embodiments, with reference to the accompanying drawings. For the sake of brief description with reference to the drawings, the same or equivalent components will be provided with the same reference numbers, and description thereof will not be repeated.

Figure 1:
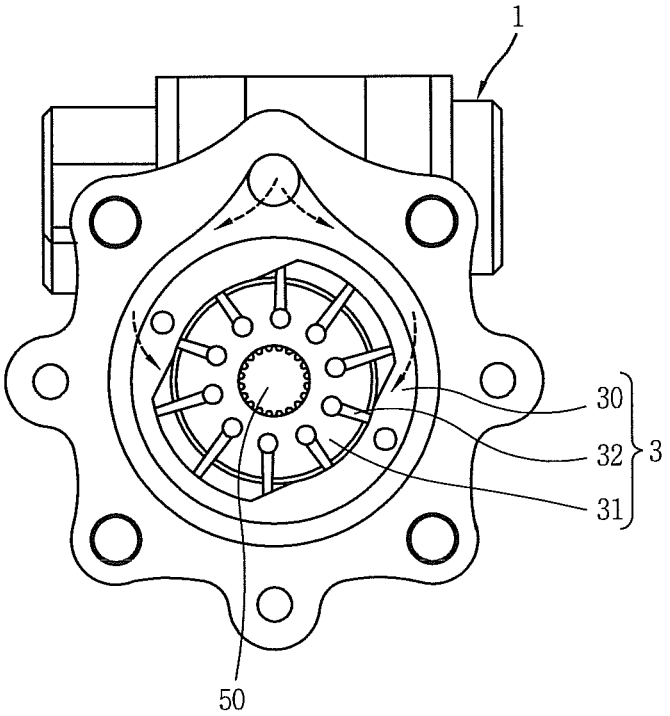
FIG. 1 RELATED ART
FIG. 1 is a schematic plan view of a related art vane pump.

Hereinafter, a vane pump according to an embodiment will be described in detail with reference to the accompanying drawings. The embodiments are directed to materials of a rotor, a vane, and a cam ring, rather than being related to a configuration of components of the vane pump, and thus, embodiments may be applied to a vane pump having any configuration including a rotor, a vane, and a cam ring. Hereinafter, the vane pump will be described based on the configuration illustrated in FIG. 1.

First, a rotor of a vane pump according to an embodiment will be described.

(1) Smelting

Elements including approximately 3.5% to 3.9% of carbon (C), approximately 2.2% to 3.0% of silicon (Si), approximately 0.1% to 0.5% of manganese (Mn), approximately 0.02% or less of sulfur (S), approximately 0.04% or less of phosphorus (P), approximately 0.1% to 0.5% of copper (Cu), approximately 0.1% to 0.3% of molybdenum (Mo), approximately 0.02% to 0.05% of magnesium, and approximately 0.01% to 0.04% of one or more rare earth resources (RE) by weight ratio, may be mixed in appropriate ratios and the mixture heated using an electric furnace, for example, and subsequently smelted.

(2) Spheroidizing and Inoculation

A nodularizer to nodularize graphite and an inoculant may be inoculated to the molten metal smelted in the smelting process. In this case, magnesium (Mg), calcium (Ca), and one or more rare earth resources (RE), known to accelerate nodularization of graphite, may be used as the nodularizer In more detail, FeSiMgRE1 including a rare earth resource, silicon (Si), iron (Fe), and magnesium (Mg) alloy, may be used, and the content may range from approximately 1.0% to 1.2% by weight ratio over the molten metal.

(3) Casting

When inoculation is completed, the molten metal after the spheroidizing and inoculation may be injected into the inoculated cast to manufacture a rotor semi-product having an intended shape.

(4) Grinding

The casted rotor semi-product may be ground to have predetermined dimensions.

(5) Heat Treatment

A heat treatment known as isothermal hardening may be applied. The rotor after grinding may be heated at a temperature ranging from approximately 880° C. to 950° C., maintained for approximately 30 minutes to 90 minutes, and input to a nitrate solution, and maintained for approximately one to three hours. In this case, the nitrate solution may contain $KNO_3$ and $NaNO_3$ in a ratio of approximately 1:1 by weight ratio. There is no particular limitation in concentration of the nitrate solution and concentration of $KNO_3$ and $NaNO_3$ forming the nitrate solution.

Thereafter, the rotor may be cooled to approximately room temperature in the atmosphere, thus completing the rotor.

Figure 2:
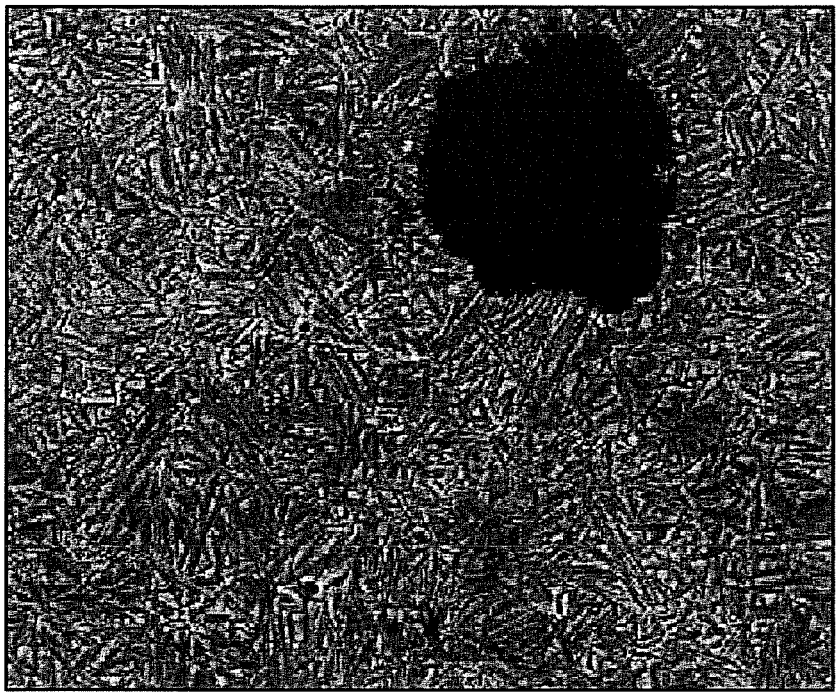
FIG. 2 is a photograph illustrating structure of a rotor provided in a vane pump according to an embodiment.
Figure 3:
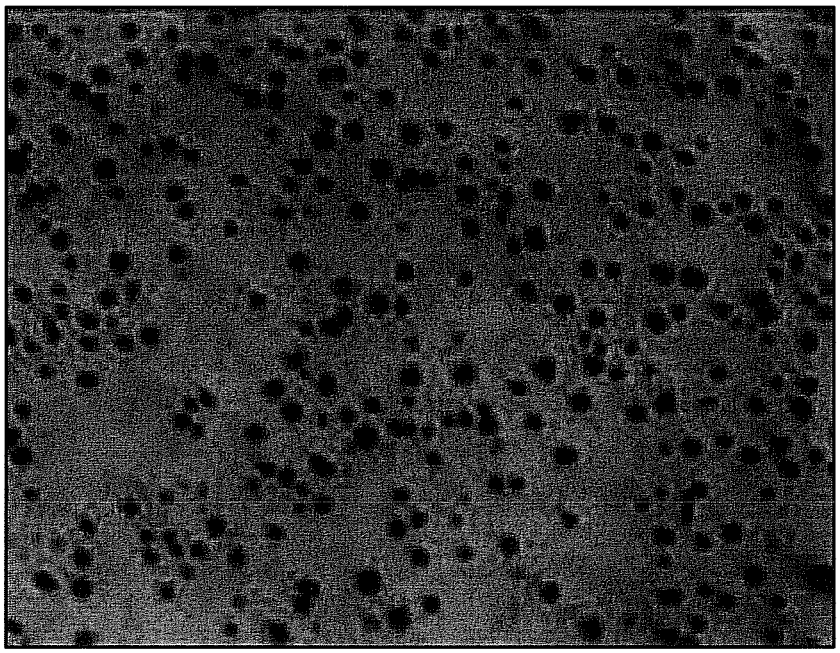
FIG. 3 is a photograph illustrating structure in which nodular graphite distribution in the rotor is shown.

Referring to FIG. 2, it can be seen that the rotor manufactured through the foregoing process is austenitized, and referring to FIG. 3, it can be seen that spheroidal graphites are evenly distributed. The number of spherical graphites may be approximately 200 or more per $mm^2$, and carbide may be approximately 5% or less of a total weight of the rotor by weight ratio.

According to measurement results of the vane, it was confirmed that tensile strength was approximately 1200 MPa or higher and a HRC hardness was approximately 50 or higher.

Meanwhile, the cam ring may be manufactured by mixing elements including C: 3.0~3.5%, Si: 2.0~2.5%, Mn: 0.5~1.0%, Cr: 0.05~1.0%, Cu: 0.2~0.5%, P: 0.1~0.3%, B: 0.02~0.06%, S: 0.06~0.1%, and Ti<0.4% by weight ratio, and casting the same.

Also, the cam ring may undergo a heat treatment. After the cam ring is casted and ground, the cam ring may be heated at a temperature ranging from approximately 860° C. to 950° C. and maintained for approximately 1 to 2 hours. Thereafter, the cam ring may be put into quenching oil at a temperature ranging from approximately 40° C. to 60° C., quenched, taken out, and cooled to reach approximately room temperature in the atmosphere.

Figure 4:
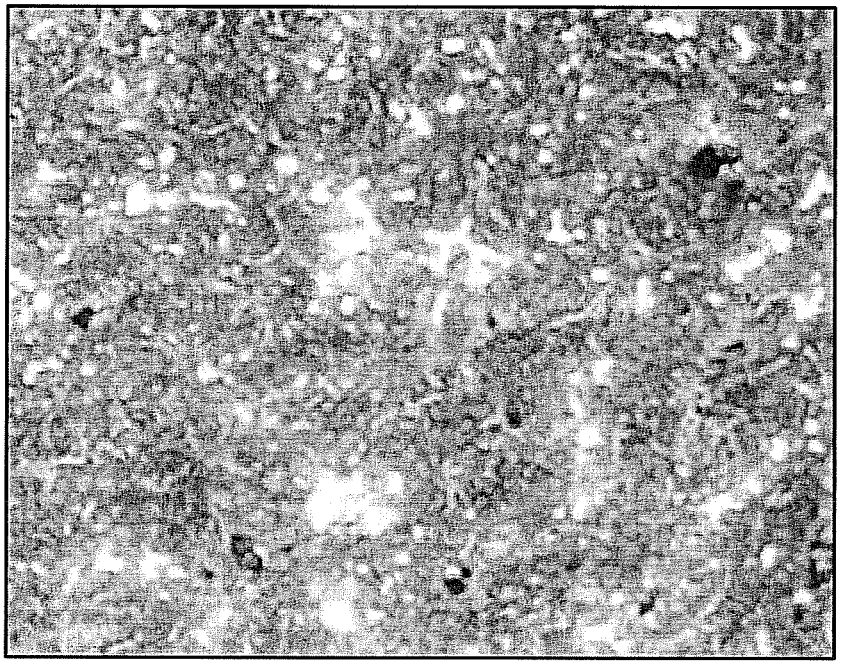
FIG. 4 is a photograph illustrating structure in which an alloy carbide distribution in a cam ring is shown according to embodiment.

It was confirmed that tensile strength of the cam ring in a casted state was approximately 300 MPa or higher, and after the cam ring was heat-treated, the cam ring had a HRC hardness equal to or higher than approximately 50. In addition, graphite before the heat treatment has approximately 70% or more of flake A-type structure and has a structure in which a length thereof based on GB/T7216 standard is included within a range of 5-7 class. In addition, it can be seen that, after the heat treatment, a metal structure has tempered martensite as a matrix structure and includes an alloy carbide distributed by approximately 4~10% of a total volume of the cam ring by volume ratio (see FIG. 4). Also, the cam ring may include a small amount of austenite structure.

Meanwhile, elements including appropriate amounts of C: 0.8~0.9%, Si: 0.2~0.45%, Mn: 0.15~0.4%, S≤0.03%, P≤0.03%, Cr: 3.8~4.4%, Mo: 4.5~5.5%, V: 1.75~2.2% , and W: 5.5~6.75% by weight ratio may be mixed to form a molten metal, and the molten metal may be casted and ground to manufacture the vane having predetermined dimensions and shape. Thereafter, the vane may be heated at a temperature ranging from approximately 1170° C. to approximately 1210° C. under a vacuum atmosphere, maintained for approximately 0.5 to 1 hour, and quenched by using liquid nitrogen, and subsequently cooled to reach room temperature in the atmosphere.

Figure 5:
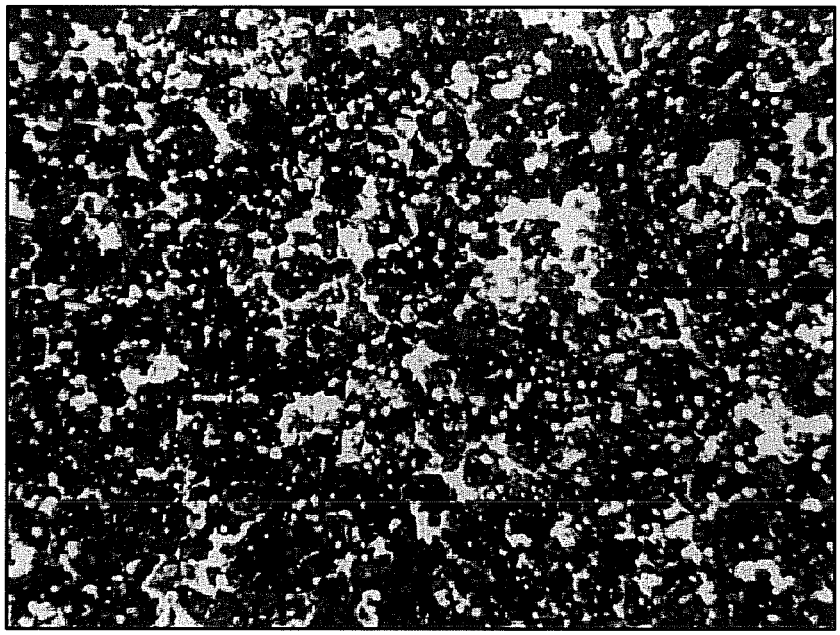
FIG. 5 is a photograph illustrating structure of the vane provided in the vane pump according to an embodiment.

Thereafter, a process of heating the vane at a temperature approximately 550° C. to 570° C. and maintaining the heated vane for approximately 2 to 3 hours may be repeatedly performed three times. After the heat treatment, hardness is approximately HRC 61 or more, and as illustrated in FIG. 5, it can be seen that the metal structure is tempered martensite.

Embodiments disclosed herein provide a vane pump capable of minimizing damage due to frictional contact although being used for a long period of time.

Embodiments disclose provide a vane pump that may include a rotor having a plurality of slots formed on an outer circumferential surface thereof; a vane slidably inserted into each of the slots; and a cam ring having the rotor therein and having a inner circumferential surface in contact with an end portion of the vane. The rotor may be formed of nodular graphite cast iron, the vane may be formed of high speed tool steel, and the cam ring may be formed of alloy cast iron.

A material of the rotor may be a nodular graphite cast iron having an austenite structure including approximately 3.5% to 3.9% of carbon (C), approximately 2.2% to 3.0% of silicon (Si), approximately 0.1% to 0.5% of manganese (Mn), approximately 0.02% or less of sulfur (S), approximately 0.04% or less of phosphorus (P) approximately 0.1% to 0.5% of copper (Cu), approximately 0.1% to 0.3% of molybdenum (Mo), approximately 0.02% to 0.05% of magnesium, and approximately 0.01% to 0.04% of one or more rare earth resources (RE) by weight ratio, and iron (Fe) and any inevitable impurity including the remainder, and having nodular graphite cast iron having an austenite structure. The rotor may include approximately 200 or more spheroidal graphites per square millimeter ($mm^2$) and carbide of approximately 5% or less of a total weight of the rotor by a weight ratio.

The rotor may undergo isothermal hardening. The rotor may have tensile strength equal to or greater than approximately 1200 MPa prior to undergoing isothermal hardening and a Rockwell hardness (HRc) equal to or greater than approximately 50 after undergoing isothermal hardening.

The isothemal hardening may include heating the rotor at a temperature ranging from approximately 880° C. to 950° C. and maintaining the heated state for approximately 30 to 90 minutes; applying the rotor to a quenching solution at a temperature ranging from approximately 200° C. to 260° C. and maintaining the state for approximately one to three hours; and cooling the rotor to reach approximately room temperature in the atmosphere. The quenching solution may be a nitrate solution in which $KNO_3$ and $NaNO_3$ are mixed in a ratio of approximately 1:1.

A material of the cam ring may be alloy cast iron including approximately 3.0% to 3.3% of carbon (C), approximately 2.0% to 2.5% of silicon (Si), approximately 0.5% to 1.0% of manganese (Mn), approximately 0.05% to 1.0% of chromium (Cr), approximately 0.2% to 0.5% of copper (Cu), approximately 0.1% to 0.3% of phosphorus (P), approximately 0.02% to 0.06% of boron (B), approximately 0.06% to 0.1% of sulfur (S), and approximately 0.4% or more of titanium (Ti), by weight ratio, and iron (Fe) and any inevitable impurity including the remainder. The cam ring may undergo isothermal hardening, and may have a tempered martensite structure in which the content of an alloy carbide ranges from approximately 4% to 10% of a total volume of the cam ring by volume ratio.

The isothermal hardening may include maintaining the cam ring at a temperature ranging from approximately 860° C. to 950° C. for approximately one to two hours; putting the cam ring into quenching oil at a temperature ranging from approximately 40° C. to 60° C.; and cooling the cam ring to reach room temperature in the atmosphere. The cam ring may have tensile strength equal to or greater than approximately 300 MPa prior to undergoing isothermal hardening and a Rockwell hardness (HRc) equal to or greater than approximately 50 after undergoing isothermal hardening.

A material of the vane may be formed of high speed tool steel including approximately 0.8% to 0.9% of carbon (C), approximately 0.2% to 0.45% of silicon (Si), approximately 0.15% to 0.4% of manganese (Mn), approximately 0.03% or less of sulfur (S), approximately 0.03% or less of phosphorus (P), approximately 3.0% to 4.4% of chromium (Cr), approximately 4.5% to 5.5% of molybdenum (Mo), approximately 1.75% to 2.2% of vanadium (V), and approximately 5.5% to 6.75% of tungsten (W) by weight ratio, and iron (Fe) and any inevitable impurity including the remainder.

The vane may undergo isothermal hardening, and may have a tempered martensite structure. The isothermal hardening may include maintaining the vane at a temperature ranging from approximately 1170° C. to 1210° C. for approximately one half to one hour; cooling the vane by using liquid nitrogen; cooling the vane to reach approximately room temperature in the atmosphere; and heating the vane to reach a temperature ranging from approximately 550° C. to 570° C. and maintaining the heated state for approximately two to three hours. The vane may have a Rockwell hardness (HRc) equal to or greater than approximately 61 after undergoing isothermal hardening.

According to embodiments, by improving materials of the cam ring and rotor, and optimizing the material of the vane, abrasion due to frictional contact that may occur during an operation of the vane pump may be minimized.

In more detail, the alloy cast iron cam ring containing P, B, Cr, and Cu may have concentratively uniformly distributed belt-type carbide particles to limit bonding wear of materials and reduce micro-deformation. In addition, as flake graphite itself has high lubricating characteristics and micro-pores formed in the flake graphite structure provide a space to store a lubricant, increasing wear resistance of the cam ring.

Further, the rotor formed of nodular graphite cast iron has high abrasion resistance and heat stability, and such characteristics may be increased together with austenite structure that may be obtained through isothermal hardening. Furthermore, even when impact is applied to the rotor during an operation, austenite remaining on the surface thereof may be work-hardened to be changed into martensite, and thus, surface hardness of the rotor may be further increased and abrasion resistance may also be increased. Also, lubricating characteristics of the nodular graphite cast iron and micro-pores formed on a surface thereof increase abrasion resistance.

The vane in direct contact with the cam ring and the rotor may be formed of a high speed tool steel material, have significant difference in structures from those of the cam ring and the rotor, and have a low coefficient of friction, so it is advantageous in reducing bonding abrasion damage. Also, carbide particles uniformly distributed in the vane may protect the material structure and lengthen a life time of the vane, considerably increasing reliability of the vane pump. In addition, the nodular graphite cast iron and alloy cast iron may require small energy consumption, relative to steel casting, and thus, it is advantageous in reducing production costs.

Further scope of applicability will become more apparent from the detailed description. However, it should be understood that the detailed description and specific examples, while indicating embodiments, are given by way of illustration only, as various changes and modifications within the spirit and scope will become apparent to those skilled in the art from the detailed description.

The foregoing embodiments and advantages are merely exemplary and are not to be considered as limiting. The teachings can be readily applied to other types of apparatuses. This description is intended to be illustrative, and not to limit the scope of the claims. Many alternatives, modifications, and variations will be apparent to those skilled in the art. The features, structures, methods, and other characteristics of the embodiments described herein may be combined in various ways to obtain additional and/or alternative embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane pump, comprising:

a rotor having a plurality of slots formed on an outer circumferential surface thereof;

a plurality of vanes, one of the plurality of vanes being slidably inserted into each of the plurality of slots, respectively; and a cam ring configured to receive the rotor therein and having an inner circumferential surface in contact with an end portion of each of the plurality of vanes, wherein each vane is formed of a high speed tool steel, wherein a material of the rotor is a nodular graphite cast iron having an austenite structure including 3.5% to 3.9% of carbon (C), 2.2% to 3.0% of silicon (Si), 0.1% to 0.5% of manganese (Mn), 0.02% or less of sulfur (S), 0.04% or less of phosphorus (P), 0.1% to 0.5% of copper (Cu), 0.1% to 0.3% of molybdenum (Mo), 0.02% to 0.05% of magnesium, and 0.01% to 0.04% of one or more rare earth resources (RE) by weight ratio, with a remainder including iron (Fe), and wherein a material of the cam ring is formed of an alloy cast iron having a tempered martensite structure including 3.0% to 3.3% of carbon (C), 2.0% to 2.5% of silicon (Si), 0.5% to 1.0% of manganese (Mn), 0.05% to 1.0% of chromium (Cr), 0.2% to 0.5% of copper (Cu), 0.1% to 0.3% of phosphorus (P), 0.02% to 0.06% of boron (B), 0.06% to 0.1% of sulfur (S), and 0.4% or more of titanium (Ti), by weight ratio.

2. The vane pump of claim 1, wherein the rotor includes 200 or more spheroidal graphites per square millimeter ($mm^2$) and carbide of 5% or less of a total weight of the rotor by a weight ratio.

3. The vane pump of claim 1, wherein the rotor undergoes an isothermal hardening.

4. The vane pump of claim 3, wherein the rotor has a tensile strength equal to or greater than 1200 MPa prior to undergoing the isothermal hardening and a Rockwell hardness (HRc) equal to or greater than HRc 50 after undergoing the isothermal hardening.

5. The vane pump of claim 4, wherein the isothemal hardening includes:

heating the rotor at a temperature ranging from 880° C. to 950° C. and maintaining the heated state for 30 to 90 minutes;

applying the rotor to a quenching solution at a temperature ranging from 200° C. to 260° C. and maintaining the state for one to three hours; and cooling the rotor to reach room temperature in the atmosphere.

6. The vane pump of claim 5, wherein the quenching solution is a nitrate solution in which $KNO_3$ and $NaNO_3$ are mixed in a ratio of 1:1.

7. The vane pump of claim 1, wherein the cam ring undergoes an isothermal hardening.

8. The vane pump of claim 7, wherein the cam ring has a tempered martensite structure in which a content of an alloy carbide ranges from 4% to 10% of a total volume of the cam ring by a volume ratio.

9. The vane pump of claim 8, wherein the isothermal hardening includes:

maintaining the cam ring at a temperature ranging from 860° C. to 950° C. for one to two hours;

putting the cam ring into a quenching oil at a temperature ranging from 40° C. to 60° C.; and cooling the cam ring to reach room temperature in the atmosphere.

10. The vane pump of claim 9, wherein the cam ring has a tensile strength equal to or greater than 300 MPa prior to undergoing the isothermal hardening and a Rockwell hardness (HRc) equal to or greater than HRc 50 after undergoing the isothermal hardening.

11. The vane pump of claim 1, wherein the high speed tool steel includes 0.8% to 0.9% of carbon (C), 0.2% to 0.45% of silicon (Si), 0.15% to 0.4% of manganese (Mn), 0.03% or less of sulfur (S), 0.03% or less of phosphorus (P), 3.0% to 4.4% of chromium (Cr), 4.5% to 5.5% of molybdenum (Mo), 1.75% to 2.2% of vanadium (V), and 5.5% to 6.75% of tungsten (W) by weight ratio, with a remainder including iron (Fe).

12. The vane pump of claim 11, wherein the vane undergoes an isothermal hardening.

13. The vane pump of claim 12, wherein the vane has a tempered martensite structure.

14. The vane pump of claim 13, wherein the isothermal hardening includes:

maintaining the vane at a temperature ranging from 1170° C. to 1210° C. for one-half to one hour;

cooling the vane using liquid nitrogen;

cooling the vane to reach room temperature in the atmosphere; and heating the vane to reach a temperature ranging from 550° C. to 570° C. and maintaining the heated state for two to three hours.

15. The vane pump of claim 14, wherein the vane has a Rockwell hardness (HRc) equal to or greater than HRc 61 after undergoing the isothermal hardening.

* * * * *